United States Patent [19]

Murray

[11] Patent Number: 4,763,755

[45] Date of Patent: Aug. 16, 1988

[54] BUCKET RELEASE ASSEMBLY FOR AERIAL DEVICE

[75] Inventor: Robert J. Murray, Toronto, Canada

[73] Assignee: Pitman Manufacturing Co., Inc., Markham, Canada

[21] Appl. No.: 57,775

[22] Filed: Jun. 3, 1987

[51] Int. Cl.[4] ..... B66F 11/04

[52] U.S. Cl. ..... 182/2; 182/222

[58] Field of Search ..... 182/2, 222; 292/304, 292/213; 248/222.3, 222.4, 551

[56] References Cited

U.S. PATENT DOCUMENTS

| | | | |
|---|---|---|---|
| 1,748,433 | 2/1930 | Wetzell | 248/222.3 |
| 2,647,294 | 8/1953 | Davis | 292/304 |
| 2,936,848 | 5/1960 | Hall | 182/2 |
| 3,295,633 | 1/1967 | Milner | 182/222 |
| 3,302,963 | 2/1967 | Rockfort | 292/304 |
| 4,334,594 | 6/1982 | Jost | 182/2 |

FOREIGN PATENT DOCUMENTS

| | | | |
|---|---|---|---|
| 47594 | of 1900 | Fed. Rep. of Germany | 292/304 |
| 87114 | 8/1936 | Sweden | 292/304 |

*Primary Examiner*—Reinaldo P. Machado

*Attorney, Agent, or Firm*—Dann, Dorfman, Herrell and Skillman

[57] ABSTRACT

A release assembly for an aerial device for pivotally releasing a worker's bucket from an upright orientation to a horizontal orientation. The assembly consists of protrusions from the worker's bucket and a rotatable latch plate for selectively engaging and disengaging the protrusions.

6 Claims, 3 Drawing Sheets

BUCKET RELEASE ASSEMBLY FOR AERIAL DEVICE

FIELD OF THE INVENTION

The invention relates to the field of aerial platform devices of the type used in construction and repair. In particular, the invention relates to a release assembly for pivotally releasing a worker's bucket on an aerial boom from an upright position to a dumping position.

BACKGROUND AND PRIOR ART

Aerial manlift devices commonly take the form of an interconnected series of one or more boom members supported on a vehicular platform. The boom members may be adjusted relative to one another, for example by a telescoping action, to various heights and angles relative to the vehicular platform to achieve access to a repair site. Alternatively, a single boom section may be raised or lowered to orient the outer end of the boom to the desired height and directional orientation.

A common attachment to an aerial manlift device is a walled platform comprising a worker's bucket which is affixed, for example by a support bracket, to the outermost end of the boom. An example of an arrangement wherein a worker's bucket is connected to the boom by a mounting bracket is shown in U.S. Pat. No. 3,295,633.

It is desirable in an aerial manlift arrangement including a worker's bucket to be able to pivotally release the worker's bucket to allow the bucket to fall from its upright position, under the influence of gravity, to a horizontal position without completely detaching the bucket from the mounting bracket structure. This feature is useful, for example, to empty water or debris which may have accumulated in the bucket, or more importantly, to assist in removing an injured worker in the event of an accident or an emergency. In prior art structures having a bucket release feature of this type, the structure utilizes a removable detent pin, whereby the bucket is held in upright position by the pin and is permitted to pivot to a horizontal orientation upon removal of the pin. An example of this type of bucket support arrangement is disclosed in U.S. Pat. No. 4,334,594. A significant drawback of a structure utilizing a removable detent pin is that any load or weight inside the worker's bucket tends to make the pin difficult to remove, and renders operation of the bucket release cumbersome when any substantial weight is present within the bucket.

SUMMARY OF THE INVENTION

It is an object of the invention to provide a novel bucket release assembly on an aerial manlift device which pivotally releases the worker's bucket from a vertical position to a horizontal position for emptying the contents therefrom.

It is a further object of the invention to provide a bucket release assembly on an aerial manlift device which is easily actuated even when the bucket contains a weight load.

The invention comprises a release assembly for pivotally releasing a worker's bucket affixed by a mounting bracket on an aerial boom from a vertical orientation to a horizontal orientation without detaching the bucket from the boom. The mounting bracket is pivotally attached to a retainer plate provided on the worker's bucket, and the pivotal connection allows the worker's bucket to move under the force of gravity from a vertical upright position to a horizontal dumping position. The bucket is maintained in its upright position by latch means comprising a rotatable plate provided inside the mounting bracket structure. The rotatable plate is provided with openings to engage protruding means, such as headed studs, provided on the bucket retainer plate. The rotatable plate includes lever means for rotating the plate between engaged and disengaged positions relative to the headed studs. In the disengaged position, the bucket is free to fall to its horizontal dumping orientation. The release assembly allows the bucket to be readily disengaged for pivotal movement without substantial hindrance by weight present inside the bucket.

DETAILED DESCRIPTION OF THE INVENTION

Figure 1:
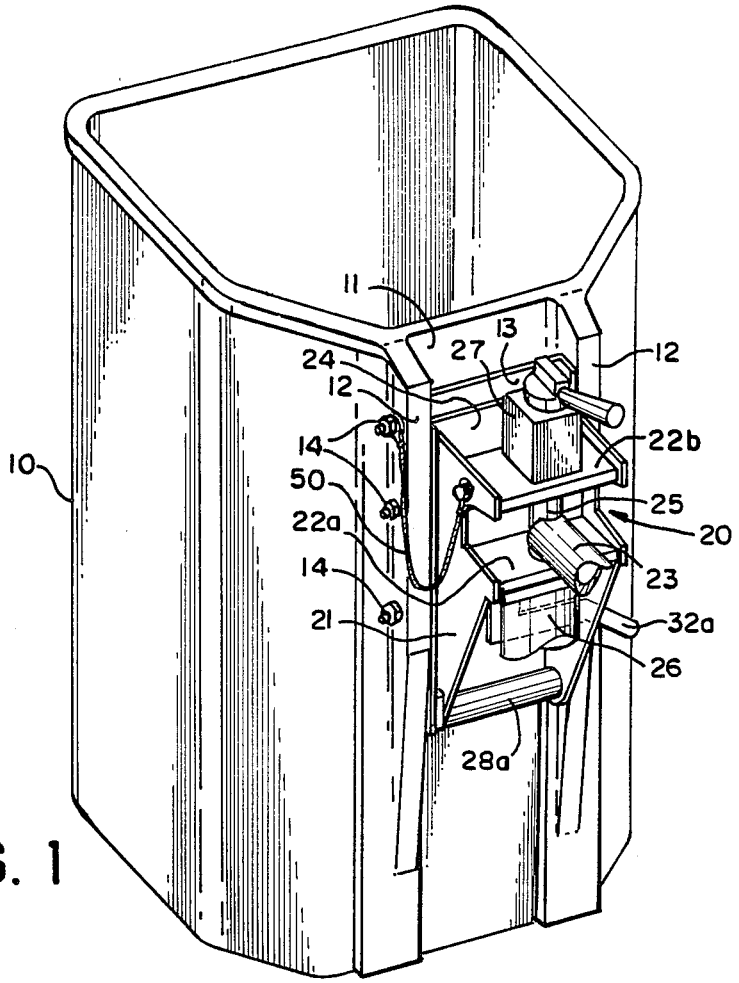
FIG. 1 is a rear perspective view of a worker's bucket including a release assembly made in accordance with the invention, the worker's bucket being shown in its vertical orientation with the release assembly in its engaged position.

In the preferred embodiment of the invention depicted in the drawings, wherein like reference numerals designate corresponding parts throughout the several views, a worker's bucket is designated generally at 10. The workers' bucket 10 is upwardly open to accommodate a worker, and is preferably formed of a dielectric material, for example reinforced plastic. On the rear side of the worker's bucket 10, an integral vertical channel 11 is formed by parallel wall protrusions 12. Secured rigidly inside the channel 11 is a retainer plate 13, which is secured in the channel 11 by bolts 14 extending through wall protrusions 12 into side flanges **13*a* provided on retainer plate 13**.

Figure 2:
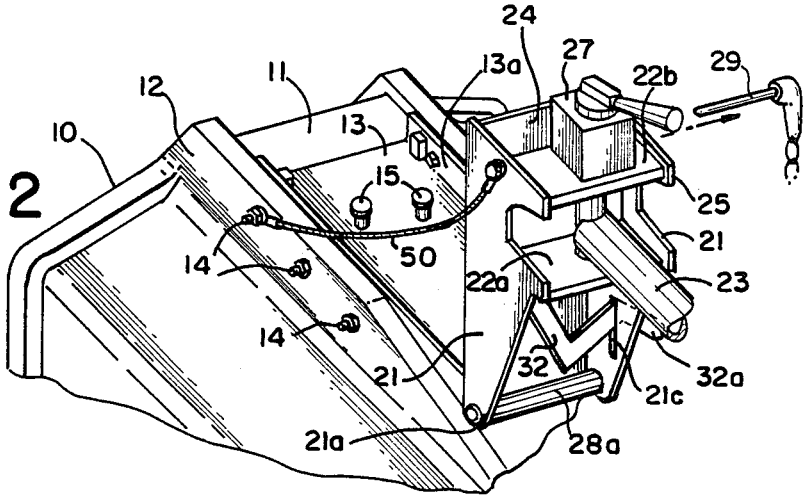
FIG. 2 is a fragmentary view of the worker's bucket of FIG. 1, the release assembly of the invention being shown in disengaged position, and the bucket shown moving towards a horizontal orientation.

Referring to FIGS. 1 and 2, a bucket-supporting mounting bracket 20 is mounted in a shaft 23 at the outer end of an aerial boom (not otherwise shown). The mounting bracket 20 generally comprises side plates 21, a rear wall 24 and lateral walls 22.

The mounting bracket 20 is mounted on the shaft 23 at the outer end of the aerial boom by a tubular weldment 25 held captive between lateral walls **22*a* and 22*b*. Weldment 25 is keyed to a piston rod (not shown) which extends from the cylinder 26 of a hydraulic rotation mechanism, up through the lower lateral wall 22*a*, through the tubular weldment 25, through the upper lateral wall 22*b*, and into a rotation control means 27. By activating the rotation control means 27, the worker's bucket may be rotated sideways under the power of the cylinder 26 relative to the shaft 23**.

Figure 3:
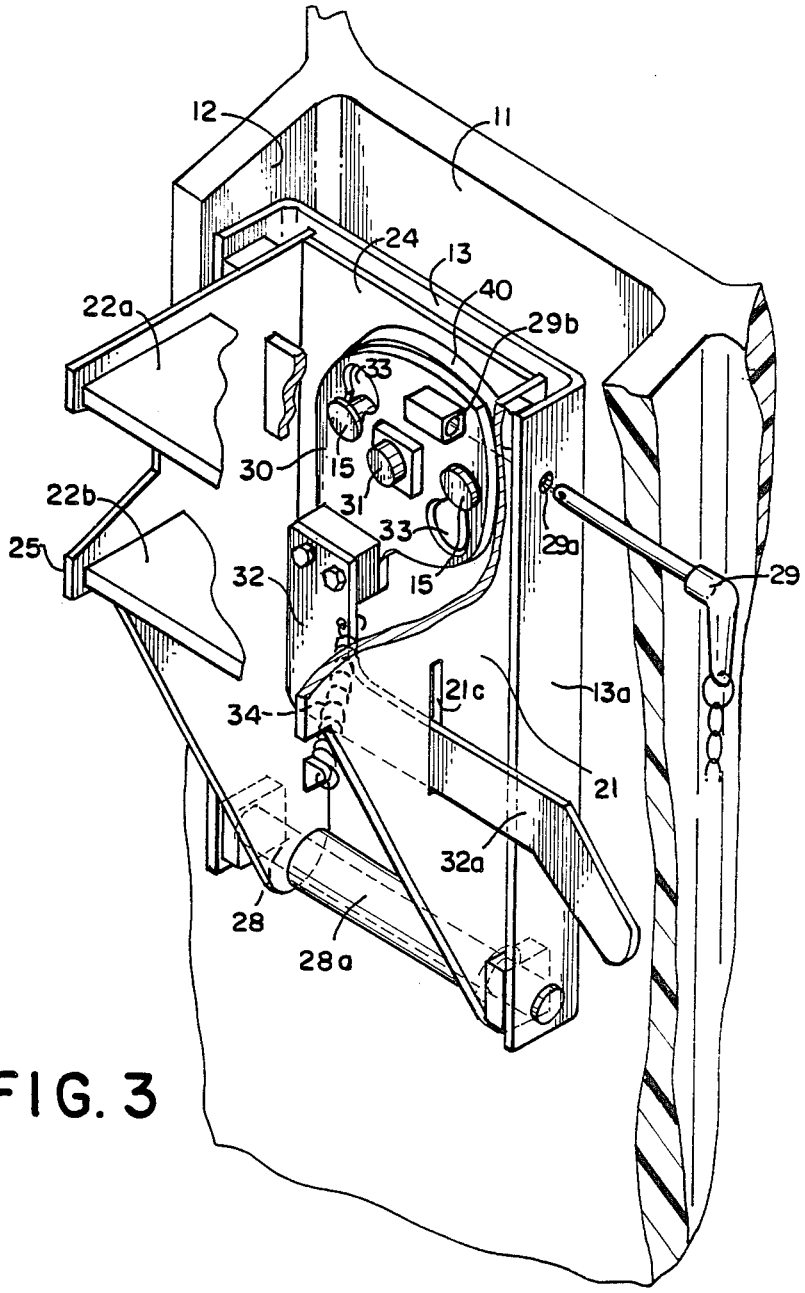
FIG. 3 is a cut-away rear perspective view of the inner detail of the bucket release assembly of the invention.
Figure 5:
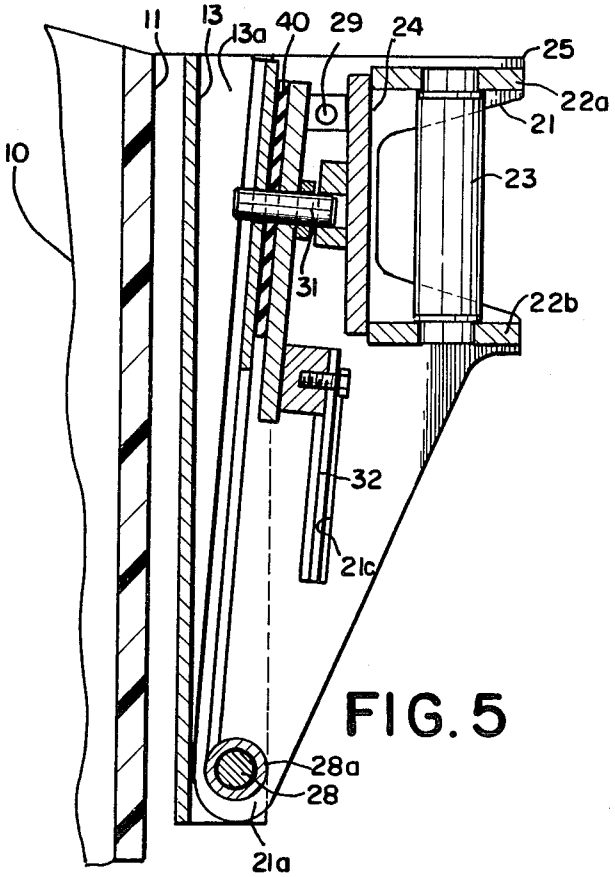
FIG. 5 is a sectional view taken along line 5—5 of FIG. 4.

Mounting bracket 20 is pivotally connected to the retainer plate 13 by a pin 28 disposed on a horizontal pivotal axis, as shown in FIG. 3. As seen in FIGS. 1 and 2, the side plates 21 of the mounting bracket 20 taper downwardly to a point at their lower end. At the narrow portion 21*a* of side plates 21, holes are provided to receive pin 28. A tube 28*a* spans between the side plates 21 to provide a journal for the pin 28. Holes are also provided in side flanges 13*a* of the retainer plate 13 to accommodate pin 28. By this arrangement, the mounting bracket 20 is pivoted to the retainer plate 13 by the pin 28, and the bucket 10 is free to pivot under its own weight relative to the shaft 23.

In accordance with the invention, a novel quick-release assembly is provided to latch the retaining plate 13 in its upright position, as shown in FIGS. 1 and 3, and is quickly and easily operated to afford pivotal movement of the plate 13 to the dumping position shown in FIG. 2. Referring to FIG. 3, latch means in the form of a rotatable latch plate 30 is rotatably secured to the rear wall 24 of the mounting bracket 20 by a bolt 31. An operator in the form of a lever 32 is affixed to latch plate 30 for rotating it. The lever 32 includes an extension 32*a* defining a handle extending through and beyond the side plate 21 of mounting bracket 20 through a slot 21*c*. Accordingly, the lever 32 can be manipulated from a position outside the mounting bracket 20. Operating the lever 32 rotates the latch plate 30 on its mounting bolt 31 between clockwise and counterclockwise limit positions as determined by the extension 32*a* engaging the opposite ends of the slot 21*c*.

The latch plate 30 is provided with openings 33 therein. Openings 33 are key-hole shaped, each comprising a large round body portion 33*a* and a narrow tail portion 33*b*. As seen in FIG. 2, the retainer plate 13 on the worker's bucket is provided with protruding means in the form of headed studs 15 projecting therefrom. The heads of the studs 15 correspond in diameter to the body portions 33*a* of the openings 33 of the latch plate 30, and the shanks of the studs correspond in diameter to the width of the tail portions 33*b*. When the worker's bucket 10 is in upright position and the latch plate 30 is rotated to its counterclockwise limit position in which the body portions register with the studs, the headed studs are positioned in alignment with the body portions 33*a* of the openings 33 and retainer plate 13 is free to separate from mounting bracket 20. When the latch plate 30 is rotated to its clockwise limit position, the headed studs are engaged within tail portions 33*b* of openings 33 and movement of retainer plate 13 away from mounting bracket 20 is prevented. Tension spring 34 is attached between lever 32 and the inner face of mounting bracket side wall 21*a*, as shown in FIGS. 3 and 4, to bias the latch plate 30 toward the clockwise limit position.

Figure 4:
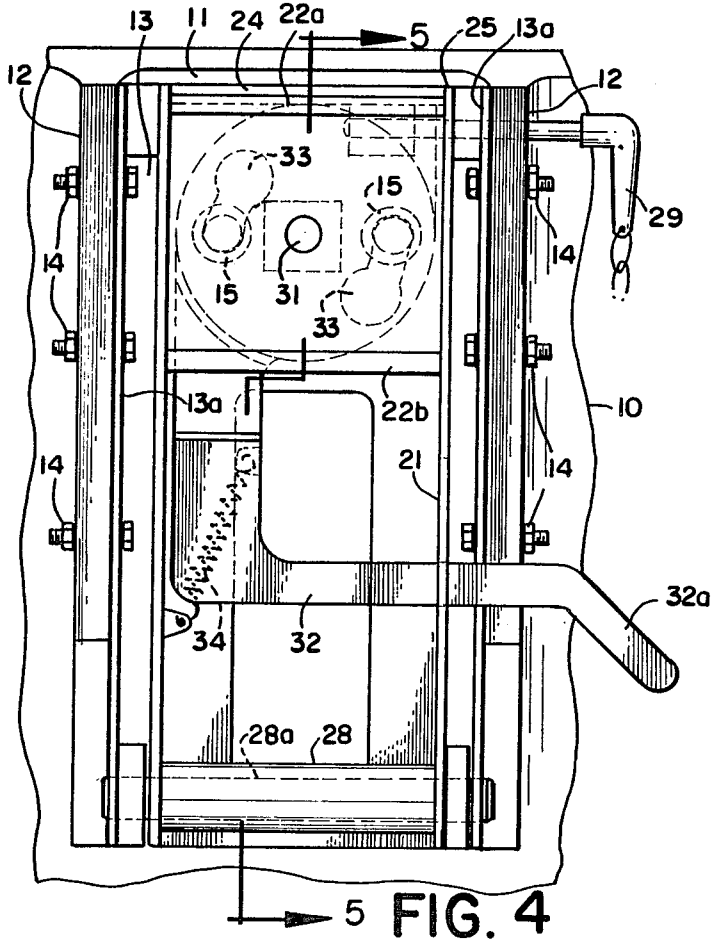
FIG. 4 is a rear elevational view of the bucket release assembly of the invention.

In operation of the release assembly, the worker's bucket 10 is normally held in an engaged verticle orientation by retention of the headed studs 15 in the tail portions 33*b* of latch plate 30 (see FIGS. 3 and 4). By operating the lever 32 upwardly by the lifting extension 32*a*, the plate 30 is rotated counterclockwise until the headed studs 15 are aligned with body portions 33*a* of the holes. Upon such alignment, the bucket 10 is free to fall under the force of gravity away from the mounting bracket 20 about the pivot pin 28. To close the worker's bucket in its upright position, it is necessary only to lift the bucket into its vertical orientation, rotating the plate to its counterclockwise limit to register the body portion 33*a* with the studs, and allow plate 30 to return to its engaged position on the headed studs 15 by the spring force on lever extension 32*a*.

It will be apparent from the foregoing that release of the worker's bucket from its upright position in accordance with the invention is greatly facilitated over release using a pin arrangement. If the worker's bucket contains a heavy load, a pulling force on the operator lever is conveyed as rotational force to the rotatable latch plate. The user may exert considerable leverage using the operator lever in accordance with the invention. With such leverage exerted, it is a relatively simple to rotate the latch plate to disengage the worker's bucket. Such facilitated operation is desirable under normal working conditions and would be particularly useful in the event of an emergency.

In the preferred embodiment of the invention, certain additional features may be provided to enhance the operation of the release assembly. For example, a safety latch in the form of a detent pin 29 may be provided to penetrate openings 29*a* in side flange 13*a* and mounting bracket side plate 21, to prevent release of the bucket under the force of gravity when the release assembly is in its disengaged position. Preferably, the pin 29 is extended to engage in a housing 29*b* on the latch plate 30 to prevent inadvertent rotation of the latch plate. It is noted that the weight of the worker's bucket, when the release assembly is in the normal engaged position, is borne by the release assembly, and not by the detent pin 10. In this manner the detent pin 29 serves as a safety feature or backup system to prevent inadvertent rotation of the plate 30 to its counterclockwise limit position. Accordingly, any weight present in the bucket does not interfere with removing the detent pin when the plate is in its normal clockwise limit position.

In the preferred embodiment, a rub pad 40, which may be formed of plastic, hard rubber or a like material, is placed behind latch plate 30, to prevent excess wear thereof. The rub pad 40 is provided with openings (not shown) to allow passage of headed studs 15 therethrough. A stop chain 50 may be affixed between the mounting bracket 20 and the worker's bucket 10 to limit the fall of the worker's bucket 10 to a desired horizontal orientation.

While the invention has been described in terms of the preferred embodiment and best mode contemplated by the inventor, various modifications will be apparent to those skilled in the art, and the above description of the preferred embodiment is intended as illustration and not as limitation on the scope of the invention.

I claim:

1. In a bucket assembly for an aerial device including a worker's bucket member supported on a boom by a mounting member, wherein the worker's bucket member is pivotally mounted to rotate relative to the mounting member from an upright orientation to a dumping orientation, a bucket release assembly comprising:

(a) protruding means on one of said members;

(b) rotatable latch means on the other of said members for retentively engaging said protruding means when said worker's bucket is in its upright orientation; and (c) means for rotating said latch means relative to the protruding means to selectively engage and disengage the retentive engagement of said protruding means by said latch means.

2. The bucket release assembly set forth in claim 1 wherein said protruding means comprises headed studs, and wherein said latch means comprises a rotatable plate provided with key-hole openings having body and tail portions to selectively engage and disengage said headed studs.

3. The bucket release assembly as set forth in claim 2 wherein said headed studs have a head corresponding in diameter to the body portion of said openings and a shank corresponding in width to the width of said tail portion.

4. The bucket release assembly as set forth in claim 3 wherein said studs are positioned in spaced-apart relation and said plate has a pivotal axis positioned midway between said studs.

5. The bucket release assembly set forth in claim 1 additionally comprising means for limiting the fall of the worker's bucket to a desired orientation.

6. In a bucket assembly for an aerial device including a worker's bucket member supported on a boom by a mounting member, wherein the worker's bucket member is pivotally mounted to rotate relative to the mounting member from an upright orientation to a dumping orientation, a bucket release assembly comprising:

(a) protruding means comprising headed studs on one of said members;

(b) rotatable latch means on the other of said members for retentively engaging said protruding means when said worker's bucket is in its upright orientation, said latch means comprising a rotatable plate provided with key-hole openings having body and tail portions to selectively engage and disengage said headed studs;

(c) means for rotating said latch means relative to the protruding means to selectively engage and disengage the retentive engagement of said protruding means by said latch means; and (d) safety retention means for retaining said bucket in its vertical orientation when said rotatable plate is disengaged from said headed studs.

* * * * *